US007264693B2

(12) United States Patent
Ahvenainen et al.

(10) Patent No.: US 7,264,693 B2
(45) Date of Patent: Sep. 4, 2007

(54) APPARATUS FOR LEADING A WEB THREADING TAIL OVER AN EMPTY SPACE

(75) Inventors: Pasi Ahvenainen, Kotka (FI); Veli-Pekka Koljonen, Kärnä (FI); Matti Lehtonen, Lannevesi (FI); Ari Mankki, Alnö (SE); Mika Ollikainen, Banglamung (TH); Pekka Hietanen, deceased, late of Jyväskylä (FI); by Eija Kinnunen, legal representative, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 551 days.

(21) Appl. No.: 10/487,788

(22) PCT Filed: Aug. 22, 2002

(86) PCT No.: PCT/FI02/00687

§ 371 (c)(1),
(2), (4) Date: Apr. 9, 2004

(87) PCT Pub. No.: WO03/018909

PCT Pub. Date: Mar. 6, 2003

(65) Prior Publication Data

US 2004/0244217 A1 Dec. 9, 2004

(30) Foreign Application Priority Data

Aug. 22, 2001 (FI) ..... 20015023

(51) Int. Cl.
*D21F 1/36* (2006.01)
*D21F 1/50* (2006.01)

(52) U.S. Cl. ..... 162/364; 162/363; 162/368; 162/373; 162/199; 162/255

(58) Field of Classification Search ..... 162/193, 162/194, 207, 232, 255, 286, 289, 306, 359.1, 162/363, 364, 367–375; 226/95, 97.1, 91, 226/92; 34/114–117, 120, 121
See application file for complete search history.

(56) References Cited

U.S. PATENT DOCUMENTS 3,355,349 A * 11/1967 Devlin ..... 162/286

(Continued)

FOREIGN PATENT DOCUMENTS

DE 36 30 571 A1 * 3/1987

(Continued)

OTHER PUBLICATIONS

International Preliminary Examination Report for PCT/FI02/006387.
International Search Report for PCT/FI02/006387.

*Primary Examiner*—Eric Hug
(74) *Attorney, Agent, or Firm*—Stiennon & Stiennon

(57) ABSTRACT

An apparatus for leading a web threading tail over an empty space formed between two surfaces, between which the apparatus (10) is arranged. The apparatus (10) includes a belt loop (28) permeable by air, which is supported by turnover rolls (29, 30). Within the belt loop (28) at least one foil strip (31) is arranged for creating a vacuum effect in the part of the belt loop (28) that transports the web threading tail (16) from the surface preceding the empty space, and to lead it to the following surface, a vacuum effect is arranged in connection with the first turnover roll (29) of the turnover rolls (29, 30).

17 Claims, 10 Drawing Sheets

U.S. PATENT DOCUMENTS 4,698,919 A * 10/1987 Wedel ..... 34/117
4,881,327 A * 11/1989 Hauser et al. ..... 34/114
5,037,509 A * 8/1991 Wedel ..... 162/286
5,918,830 A * 7/1999 Verajankorva et al. ... 242/541.1
6,219,934 B1 * 4/2001 Moskowitz ..... 34/117
6,290,817 B1 * 9/2001 Autio ..... 162/289
6,358,366 B1 * 3/2002 Hongisto et al. ..... 162/193
6,648,198 B2 * 11/2003 Demers ..... 226/95

FOREIGN PATENT DOCUMENTS

DE 200 19 346 U1 * 2/2001
WO WO 00/19013 4/2000
WO WO 03/018909 3/2003

* cited by examiner

APPARATUS FOR LEADING A WEB THREADING TAIL OVER AN EMPTY SPACE

CROSS REFERENCES TO RELATED APPLICATIONS

This application is a U.S. national stage application of International Application No. PCT/FI02/00687, filed Aug. 22, 2002, and claims priority on Finnish Application No. FI 20015023, Filed Aug. 22, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to apparatus for leading a web threading tail over an empty space, which empty space is formed between two surfaces and the apparatus is arranged between the surfaces to lead the web threading tail from the surface preceding the empty space, over the empty space to the surface following the empty space, which apparatus includes a belt loop permeable by air, which is arranged to rotate in the direction of travel of the web threading tail and is supported by turnover rolls, and within which belt loop at least one foil strip is arranged to create a vacuum effect in the part of the belt loop that transports the web threading tail.

Empty spaces according to the introduction occur particularly in the dryer sections of twin-wire paper and board machines. The dryer section includes one or more cylinder groups, with drying cylinders set on two levels. In order to lead the web through the cylinders, each level has a separate wire running through it. This arrangement is termed a twin-wire dryer section. The web is guided by means of turnover rolls placed between the drying cylinders, in such a way that both the web and the wire travel for the longest possible distance on the surface of the drying cylinders. In practice, the web is lead over alternate drying cylinders on the different levels. Thus the web travels unsupported from one level to the other, over the empty space between the two levels. There are also similar empty spaces elsewhere in paper machines, for example, in the press section.

During normal operation, an empty space has little effect on the travel of the web in a twin-wire dryer section. However, when starting up production, the web is taken through the dryer section with the aid of a web threading tail cut from the web. This web threading tail that runs between the drying cylinder and the wire tends to catch on the surface of the drying cylinder, though it should move over the empty space into the closing throat formed by a drying cylinder and the wire on the other level. Because of this, special apparatuses are used to carry the web threading tail over the empty space from the opening throat to the closing throat.

Usually the web threading tail is carried by ropeways, but nowadays these are being removed, due to their unreliable and even dangerous operation. Cable-less apparatuses have therefore been developed, in which the web threading tail is lead over empty spaces with the aid of various guide plates with associated air jets. In addition, particularly in dryer sections, doctors are used to transfer the web threading tail from the drying cylinder to the guide plate. In the doctor, a blade or an air jet can be used. The doctors, guide plates, and air jets can also be separate.

The doctoring result achieved using an air jet is generally poor, which leads to breaks when leading the web threading tail. Frequently, attempts are made to improve the doctoring result by increasing the power of the air jet, but the jet then often interferes with the movement of the web threading tail. As air jets have mainly only a guiding effect, they cannot be used to tension the web threading tail. In addition, the nozzles used to create the jet are sensitive to variations in conditions and can only be imprecisely controlled. Doctor blades in contact with the surface of the drying cylinder wear in use and have a complex construction. In practice, threading must be assisted with manually-operated jet pipes, or even by hand, which substantially impairs work safety.

For long empty spaces, apparatuses based on a belt loop have also been developed. In it, the web threading tail, which is lead onto the belt loop, is propelled forwards by the rotation of the belt loop and a vacuum arranged inside it. WO publication number 0019013 discloses such an apparatus. However, the known devices are long, making it impossible to apply them, for example, to empty spaces in a dryer section. In addition, the apparatus requires special devices to detach the web threading tail and guide it on to the belt loop.

SUMMARY OF THE INVENTION

The invention is intended to create a new apparatus for leading a web threading tail over an empty space, which is smaller and more reliable than previously, and by means of which the drawbacks of the state of the art are eliminated. The apparatus according to the invention is small in size and can be easily located between structures. By means of the apparatus according to the invention, the web threading tail can be reliably detached from the surface preceding the empty space and transferred in a controlled manner to the surface following the empty space. In addition, the apparatus requires little power and its operation is easy to control.

BRIEF DESCRIPTION OF THE DRAWINGS

In the following, the invention is examined in detail with reference to the accompanying drawings showing some embodiments of the invention.

DESCRIPTION OF THE PREFERRED EMBODIMENTS

Figure 1:
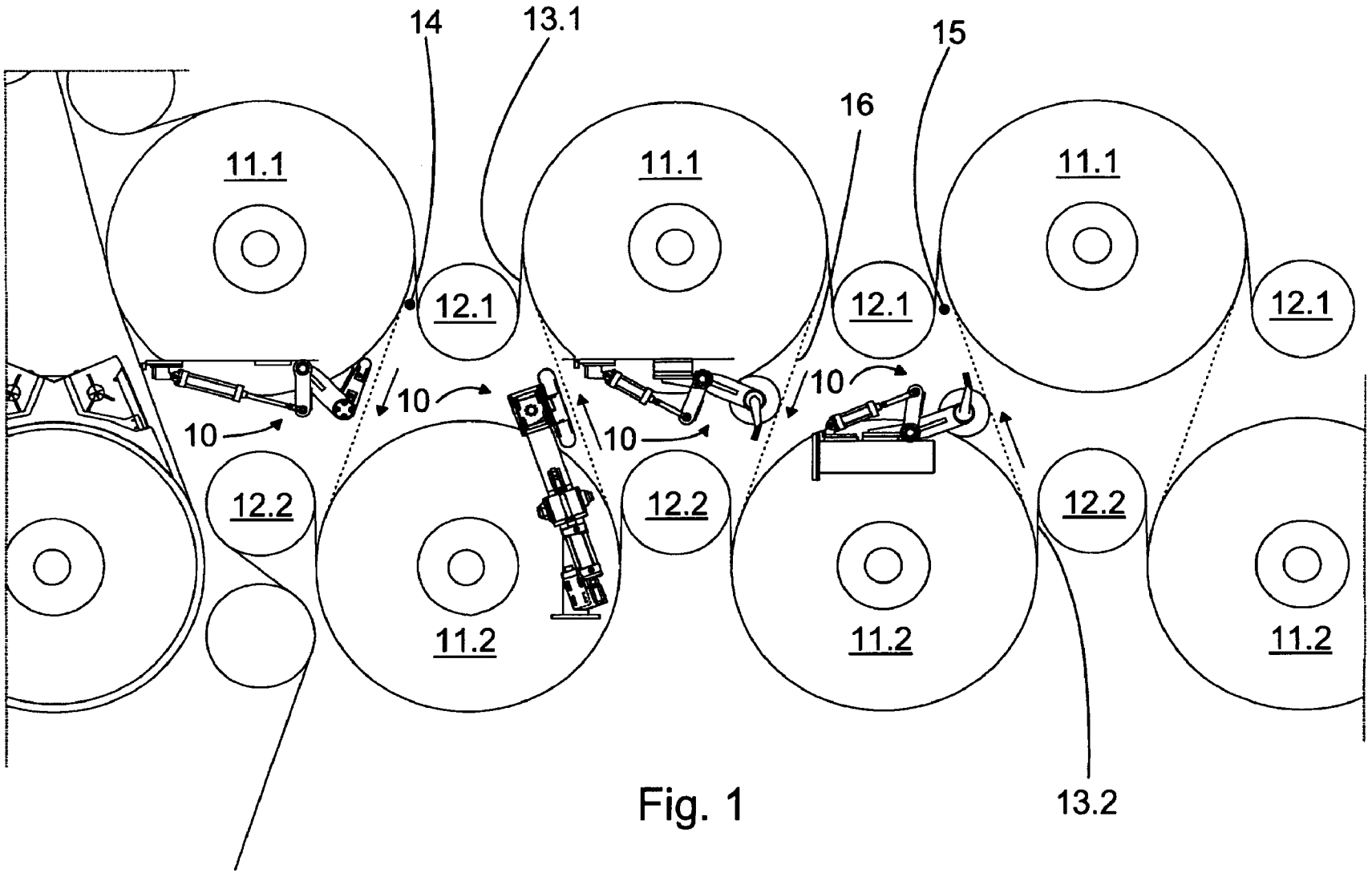
FIG. 1 shows a side view of a dryer section equipped with apparatuses according to the invention, according to the invention.

FIG. 1 shows four apparatuses 10 according to the invention, for leading a web threading tail 16 over an empty space in a twin-wire dryer section. In FIG. 1, the apparatuses are shown in the operating position. The drying cylinders 11.1 and 11.2 belonging to the dryer section are arranged, in a known manner, on two levels. The figures do not, however, show the frame constructions of the dryer section or the bearings of the drying cylinders. In addition, on each level, between the drying cylinders 11.1 and 11.2, there are turnover rolls 12.1 and 12.2, which are used to lead the wire 13.1 and 13.2 through the consecutive drying cylinders 11.1 and 11.2 of the level. During operation, however, the web travels alternately from one level to the other. Thus, when production is started up, the web threading tail 16 must first be taken from the opening throat 14 of one level, over the empty space, to the closing throat 15 of the other level. In FIG. 1, the web threading tail 16 in the empty space is shown by a broken line. Each throat is formed in each case between a drying cylinder and the wire on the same level.

Figure 6:
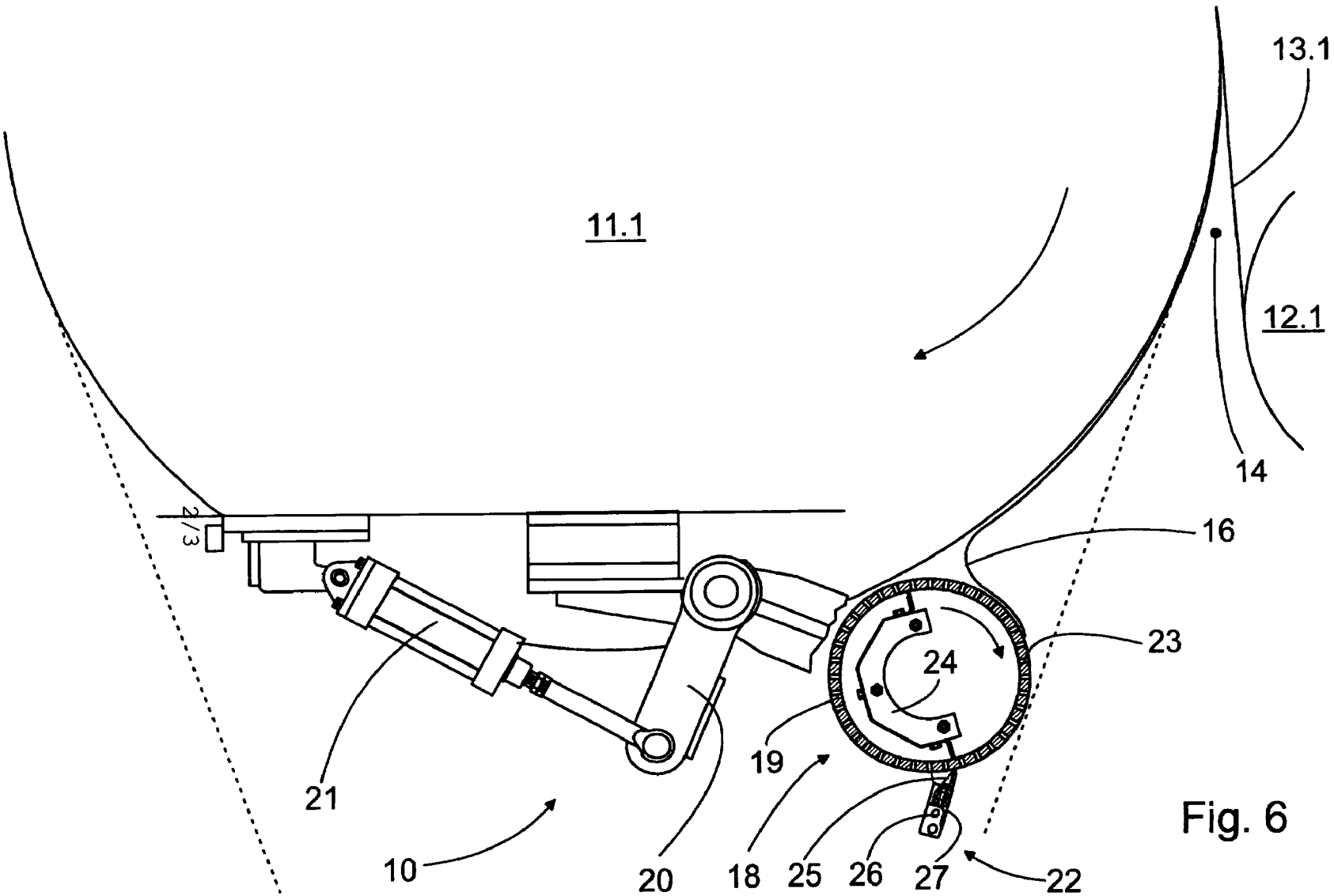
FIG. 6 shows a partial cross-section of a second apparatus according to the invention.

For threading to succeed, an apparatus must be fitted in each empty space. After the opening throat 14, the web threading tail 16 travelling between the drying cylinder 11.1 and the wire 13.1 tends to adhere to the surface of the hot drying cylinder 11.1 (FIG. 6). Thus the web threading tail must first be detached from the surface of the drying cylinder and then guided into the closing throat. According to the invention, after the opening throat, a vacuum is used to detach the web threading tail from the surface of the drying cylinder. For this purpose, the apparatus 10 according to the invention includes a rotatable drum 18, which is arranged close to the opening throat 14 at a distance from the drying cylinder 11.1. The use of a vacuum eliminates the air jets that would disturb the movement of the web threading tail. It is also easy to regulate a vacuum, while the rotating drum also guides the web threading tail. The drum can also be dimensioned to be advantageously small, so that it is simple to place it in the throat. In addition, the drum is impervious to varying conditions.

The drum is fitted away from the surface of the drying cylinder, so that it does not wear and has no effect on the drying cylinder. The gap is usually 2-10 mm, preferably 3-6 mm. Thus, there are then fewer restrictions than previously on the placing of the drum and greater tolerances in its location. Thus, the web threading tail is detached by means of the rotating drum, in connection with which a vacuum is arranged. As the gap is small, only a small vacuum is required. On the other hand, the detaching of the web threading tail can be ensured by using a greater vacuum, without, however, this disturbing the movement of the web threading tail. The construction of the drum 18, which incorporates a perforated jacket 19, is described in greater detail in connection with FIG. 6. The same reference numbers are used for operationally similar components.

Figure 3A:
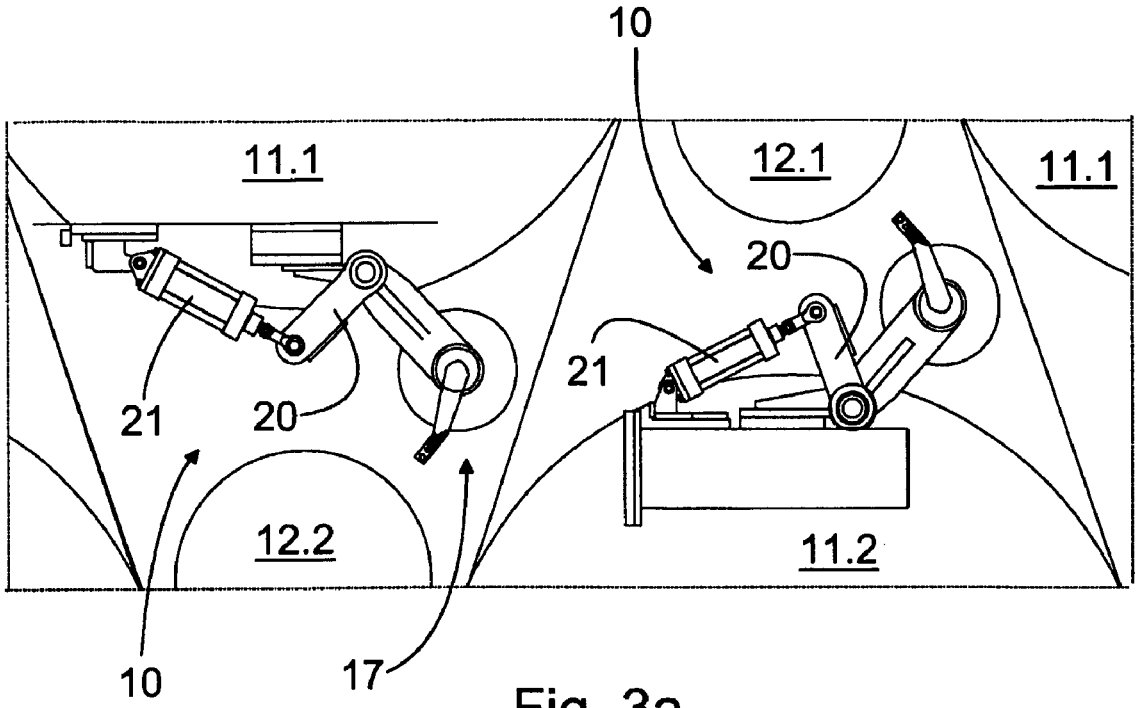
FIGS. 3*a* and 3*b* show side views of an apparatus according to the invention, turned to the rest position.
Figure 3B:
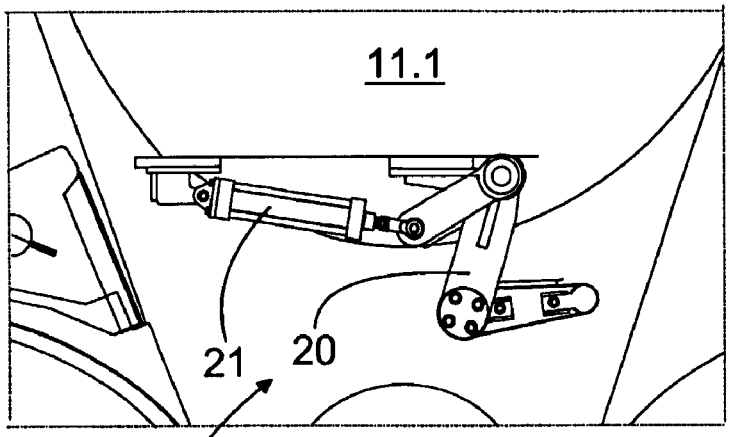

The apparatus is used specifically for leading and guiding a web threading tail. During the normal operation of the dryer section, the apparatuses according to the invention can be turned to the rest position. For this purpose, an articulated arm is used to create a swivelling support for the apparatus on the structure of the dryer section. In the apparatuses shown in the figures, the articulated arm 20 is attached at one point by bearings to the structure of the dryer section. Correspondingly, the drum 18 is attached to one branch of the articulated arm 20 and the operating device 21 to the other branch. In this case, the operating device 21 is a compressed-air cylinder, which is also attached to the structure of the dryer section. By suitable dimensioning, the apparatus can be moved simply to a sufficient distance from the drying cylinders and the web. In addition, the apparatus can be easily and rapidly swivelled from the rest position to the operating position and back again. FIGS. 3*a* and 3*b* show three of the apparatuses 10 shown in FIG. 1 turned to the rest position. In practice, the drum can be turned to as much as 100 mm from the drying cylinder. Its corresponding distance from the web is at least 40 mm.

Figure 2:
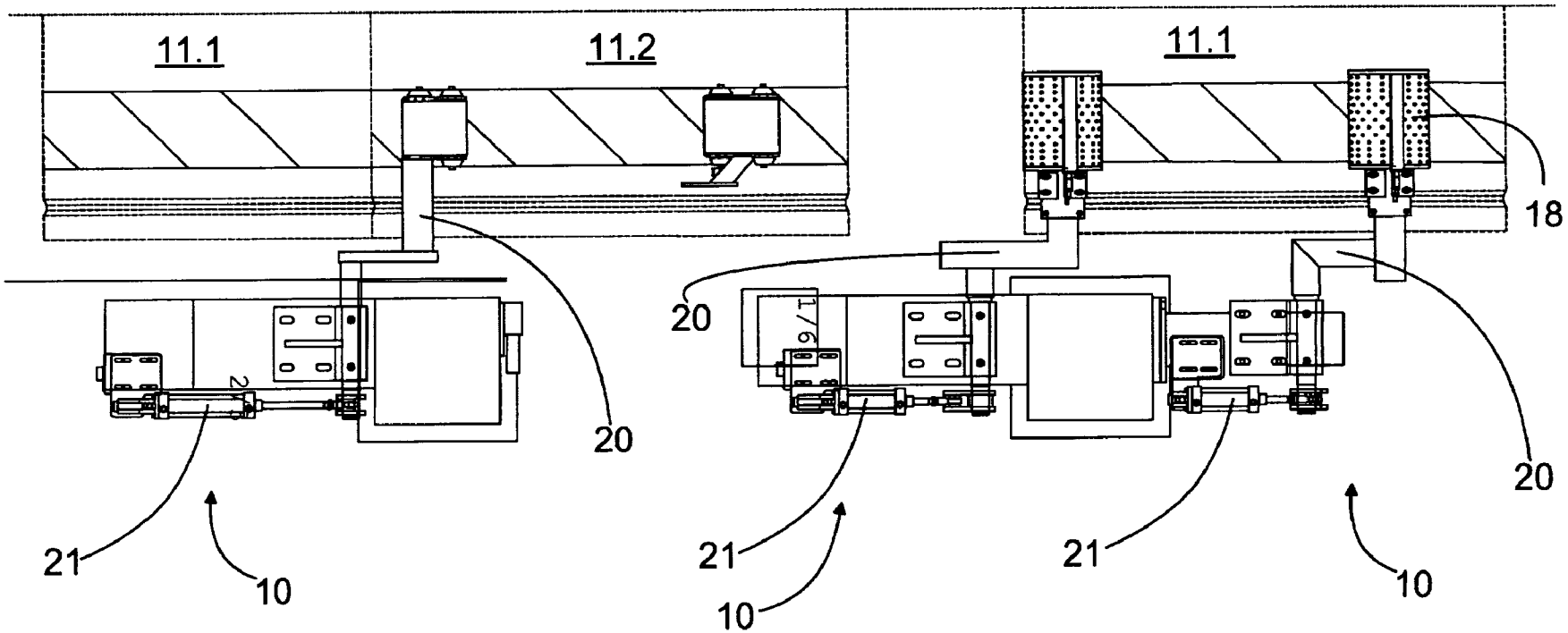
FIG. 2 shows a top view of the apparatuses of FIG. 1.

FIG. 2 shows the apparatuses 10 of FIG. 1 seen from above. Due to the articulated arms 20, some of the apparatuses can be placed outside the drying cylinders 11.1 and 11.2. In that case, the operating devices 21 also remain to the side of the dryer section. The location of the web threading tail is shown by hatching.

Figure 5A:
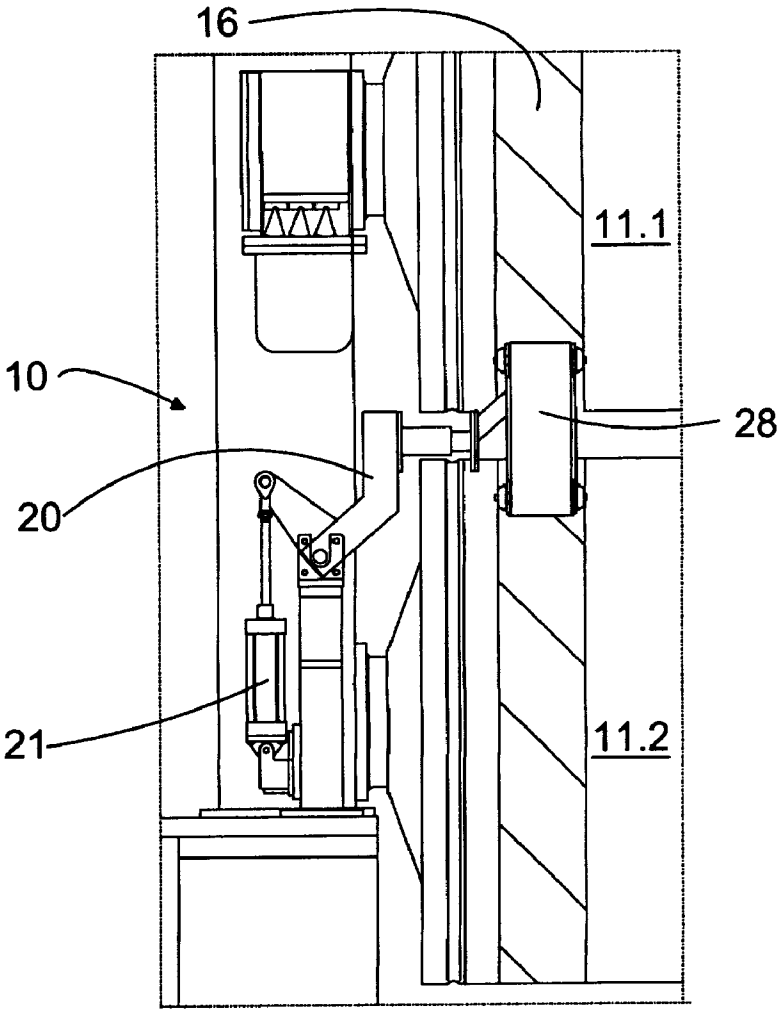
FIGS. 5*a* and 5*b* show one apparatus according to the invention in the operating and rest positions, seen in the machine direction.
Figure 5B:
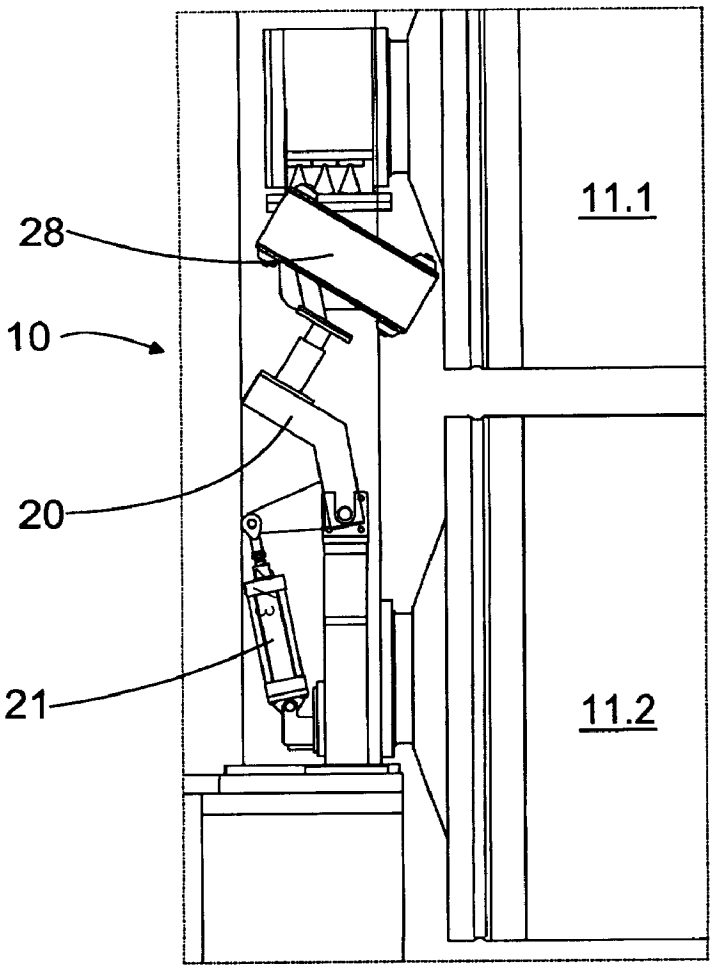

FIGS. 5*a* and 5*b* show the support of the second apparatus from the left in FIG. 2 in greater detail. Here, the articulated arm 21 is mounted on bearings and aligned parallel to the machine direction. Thus, the operating device 21 can be used to swivel the drum completely away from between the drying cylinders 11.1 and 11.2, so that it is unlikely that the apparatus 10 will be broken or dirtied. Correspondingly, the apparatus can be serviced when the dryer section is operating normally. By arranging suitable adjustment allowances in the articulated arm and its support, a single type of apparatus can be fitted in very different positions.

Generally, the apparatus 10 includes devices 22 arranged after the drum 18 in the direction of travel of the web threading tail, for leading the web threading tail to the next closing throat. This ensures the transfer of the web threading tail over the empty space. FIG. 6 shows one apparatus 10 according to the invention, in which the jacket 19 of the drum 18 is in cross section, so that the holes 23 are clearly visible. The drum 18 is rotated counter to the direction of rotation of the drying cylinder 11.1, so that the web threading tail 16 is detached from the surface of the drying cylinder 11.1 and guided towards the closing throat. Thus the web threading tail detaching air jets used in the state of the art are unnecessary. FIG. 6 shows the situation immediately after the detaching of the web threading tail. The actual detaching takes place using a vacuum, which is created inside the drum 18. For this purpose, a vacuum box 24 is fitted inside the drum 18, and generally covers 20-70%, preferably 30-60% of the inner circumference of the drum. In FIG. 6, the vacuum box 24 covers about one half of the inner circumference of the drum. For this distance, the web threading tail 16 is arranged to travel on the surface of the drum 18. In order to guide the web threading tail 16 onwards, the devices 22 also include air jets 25 and 26. The first jet 25 is directed towards the drum 18 and against its direction of rotation. Thus, when the vacuum effect ends, the web threading tail 16 is also detached from the surface of the drum 18 by the jet. A high-pressure box (not shown) can also be fitted inside the drum, in the same way as the vacuum box. In that case, the web threading tail can be detached from the surface of the drum after the vacuum by the blast formed by the high pressure. The next jet 26 is directed towards the closing throat, allowing the web threading tail to be guided for as long as possible. In the figures, both jets 25 and 26 are arranged in connection with the same guide surface 27.

In the second apparatus according to the invention, the devices 22 include a belt loop 28 permeable by air. The belt application is shown in partial cross-section in FIG. 4. The belt loop 28 is arranged to rotate in the direction of travel of the web threading tail 16, supported by the turnover rolls 29 and 30. Thus, the web threading tail 16 can be guided for a greater distance and more precisely. It is also essential that the first of the turnover rolls 29 is specifically the drum 18 with a vacuum, described above, with a construction corresponding to that described above. Thus, the web threading tail 16 is detached from the surface of the drying cylinder 11.2 and simultaneously transferred towards the closing throat, by means of the belt loop 28. Further, at least one foil strip 31 is arranged between the turnover rolls 29 and 30, inside the belt loop 28, to create a vacuum effect on the surface of the belt loop. Thus, the web threading tail will remain firmly on top of the belt loop, which makes the operation of the apparatus particularly reliable.

Figure 4:
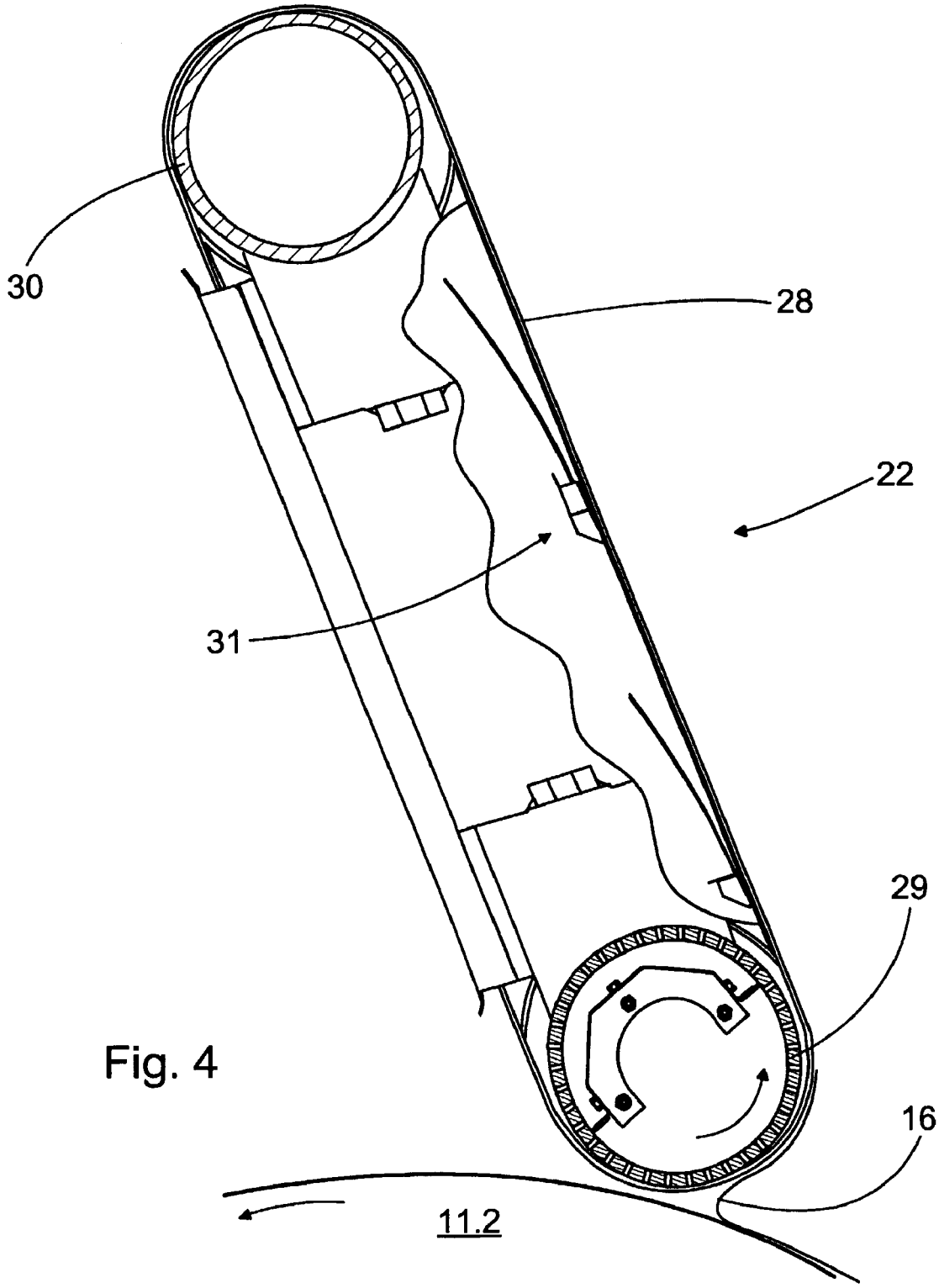
FIG. 4 shows a partial cross-section of the apparatus of FIG. 5*a*.

In FIG. 4, the vacuum in the area of the belt loop 28 is mainly created by means of two foil strips 31. Generally, there are 1-3 foil strips, preferably only one. In addition, the distance between the turnover rolls 29 and 30 is in practice 200-600 mm, preferably 300-500 mm. Thus, the apparatus according to the invention is very short compared to known belt applications. In addition, due to the turnover roll with the vacuum effect, there is little need for any other vacuum effect, so that fewer foil strips than before are required. Correspondingly, the apparatus can be made sufficiently wide. For example, in the application of FIG. 10, the belt loop is 550 mm wide and is depicted with a broken line. According to the invention, the vacuum inside the belt loop is created with the aid of a foil effect, without actual suction devices. The foil effect arises, when the tip of the foil strip is in contact, or nearly in contact, with the moving surface of the belt (FIG. 4). The air on the edge of the foil strip is then directed downwards by the surface of the foil strip and a vacuum arises on the trailing edge of the foil strip. The foil effect can be boosted using Coanda jets, which are usually optional and adjustable.

Both of the apparatuses disclosed according to the invention can also be used to tension the web threading tail. Tensioning is achieved by rotating the drum faster than the web. Especially the drum itself can be rotated at even a much higher speed than the web, as after the detaching of the web threading tail the web threading tail only touches the drum for a short distance. Once the tail threading has succeeded, the web threading tail detaches entirely from the drum (FIG. 1). In the belt application, a small difference in speed is used, as the web threading tail adheres to the belt. Using a suitable difference in speed, the web threading tail can be made to remain tight, which will ensure the success of the tail threading. In practice, a speed 2-5% greater than the speed of the web is used. The effect of the vacuum keeps the web threading tail firmly on the belt. The belt can have a roughened upper surface, which will make it easier for the apparatus to detach the web threading tail from the drying cylinder. Correspondingly, the surface of the drum can be roughened, or suitably surfaced, for example, with a plastic mesh permeable by air (not shown).

In the apparatus described, the diameter of the drum itself is about 300 mm. In belt applications, the turnover roll is considerably smaller. According to FIG. 2, the drum 18 is wider than the web threading tail, in which case the vacuum is suitable equalized. The belt application can even be narrower than the web threading tail, due to the comprehensive vacuum effect. In connection with the drum, the guiding effect of the apparatus can be improved by using additional jets, but in principle the guide surfaces shown in the figures and the jets fitted to them are sufficient. The belt application can be dimensioned for individual cases.

Figure 8A:
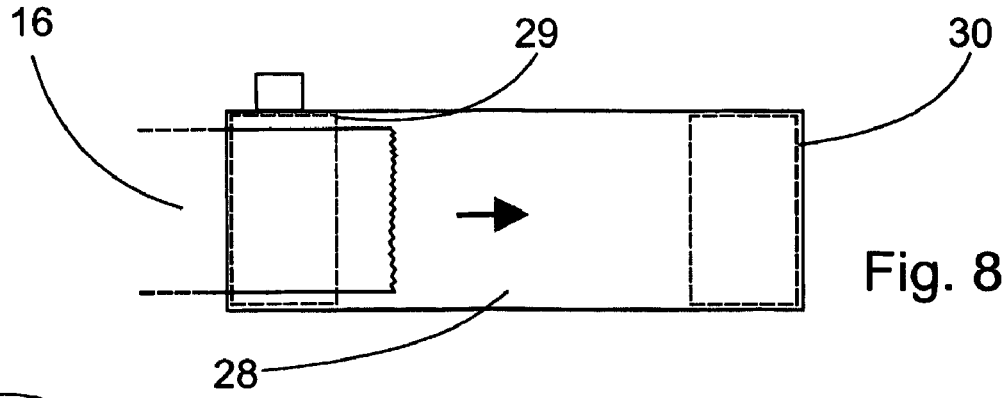
FIG. 8*a* shows a schematic diagram of the apparatus of FIG. 4, seen from above.
Figure 8B:
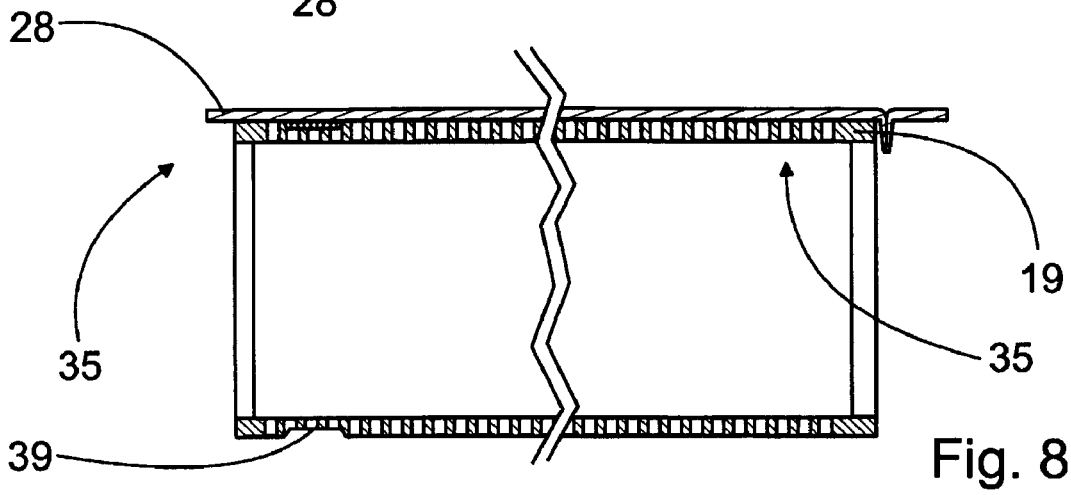
FIGS. 8*b*-8*d* show partial cross-sections of a variation of the apparatus of FIG. 4.
Figure 8C:
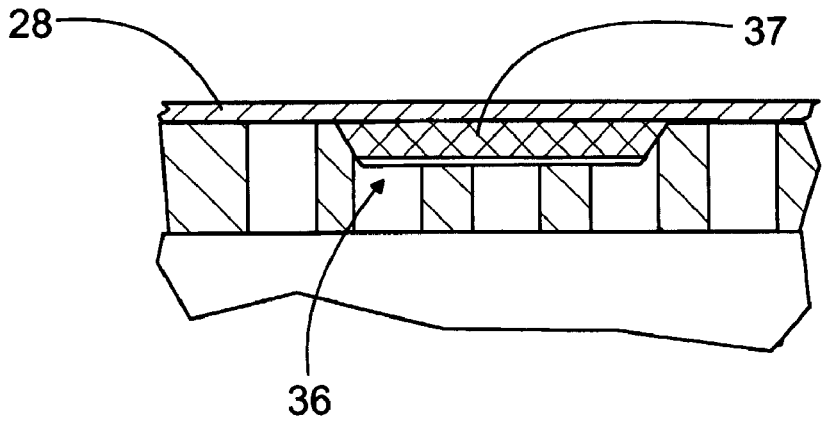
Figure 8D:
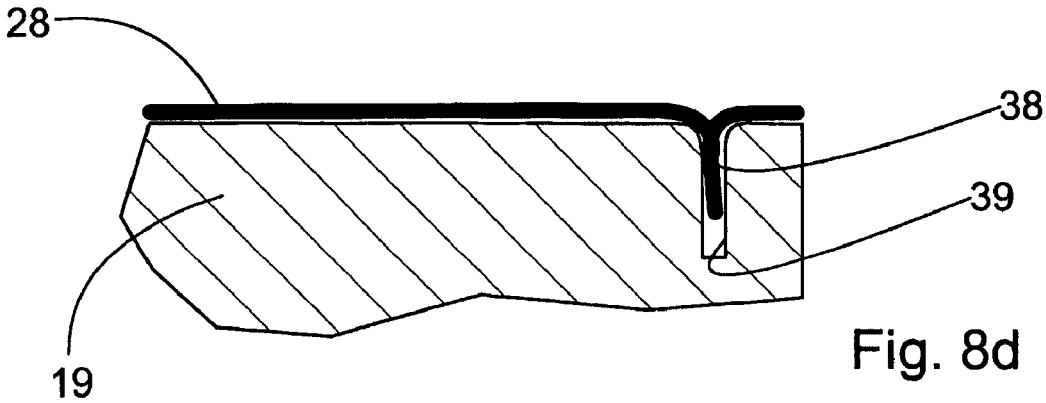

FIG. 8*a* shows a schematic diagram of a belt application of the apparatus according to the invention. A belt loop 28, which moves in the direction shown by the arrow, is supported on the turnover rolls 29 and 30. The web threading tail 16 is lead on top of the belt loop 28. Correspondingly, FIGS. 8*b*-8*d* show a surprising solution, by means of which the belt loop is made to remain firmly in place on top of the turnover rolls. According to the invention, at least one longitudinal guide member 35 is arranged in the belt loop 28, a space corresponding to the guide member being arranged in connection with the turnover rolls 29 and 30, to retain the belt loop 28 on the turnover rolls 29 and 30. In practice, the guide member can be a protrusion 37 attached to the belt loop 28, or a fold 38 in the belt loop. The protrusion can be, for example, easily glued to the belt loop, which is, in practice, usually a short and narrow wire. The fold shown in FIG. 8*d* can be formed simply by weaving a suitable crease into the wire. FIG. 8*b* shows the two different applications at the opposite ends of the drum. The crease can also be at the edges of the wire, making machining in the jacket 19 of the drum 18 unnecessary. Similarly, the space 36 can be a corresponding recess 39 arranged in the jacket 19 of the turnover roll 29 and 30. Using the methods shown, the belt loop will remain in place without unnecessary tensioning and despite the loosening caused by heat. There will also be no need to camber the turnover rolls.

Figure 9:
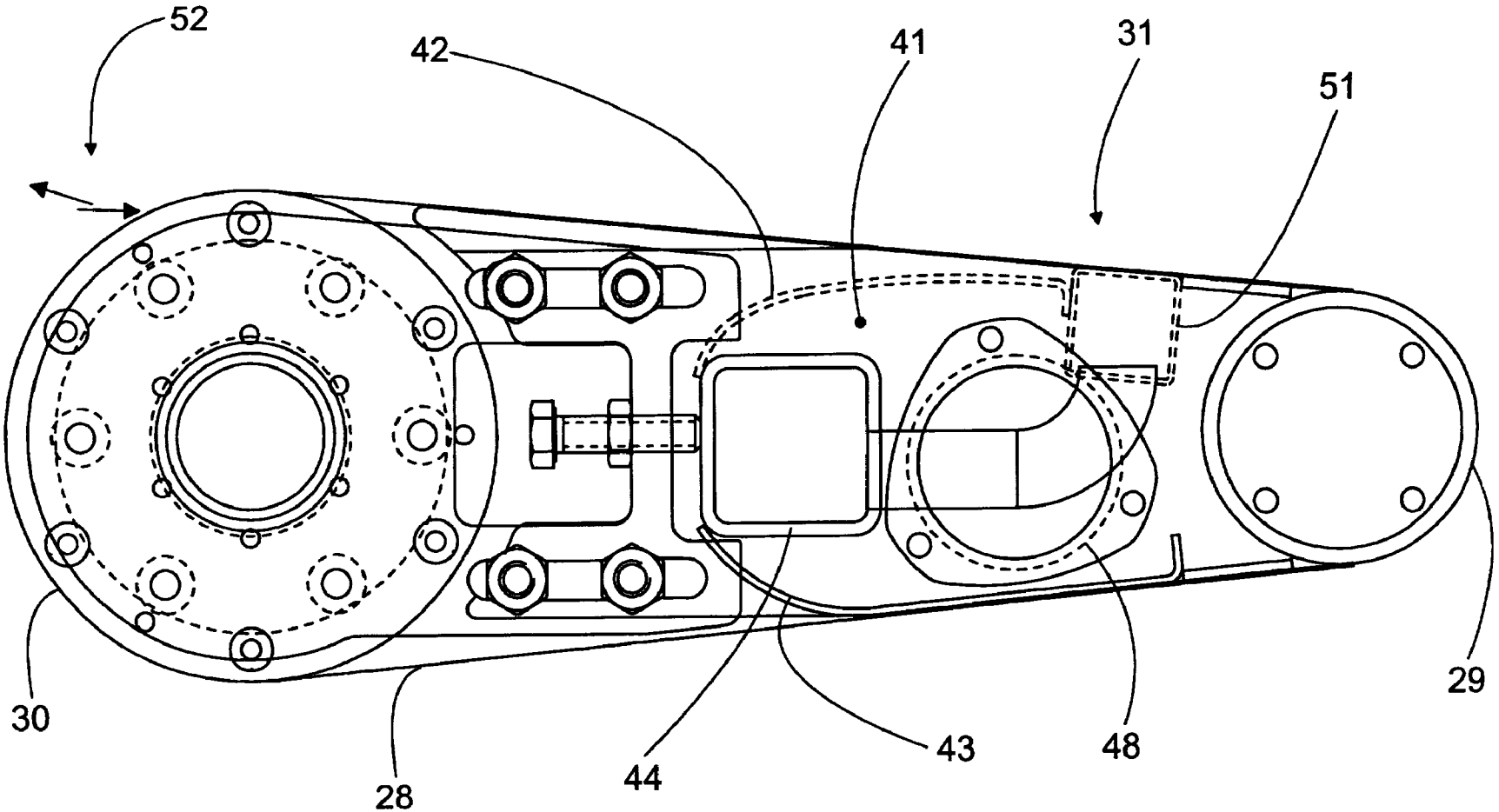
FIG. 9 shows a side view of a second application of the apparatus of FIG. 5*a*.
Figure 10:
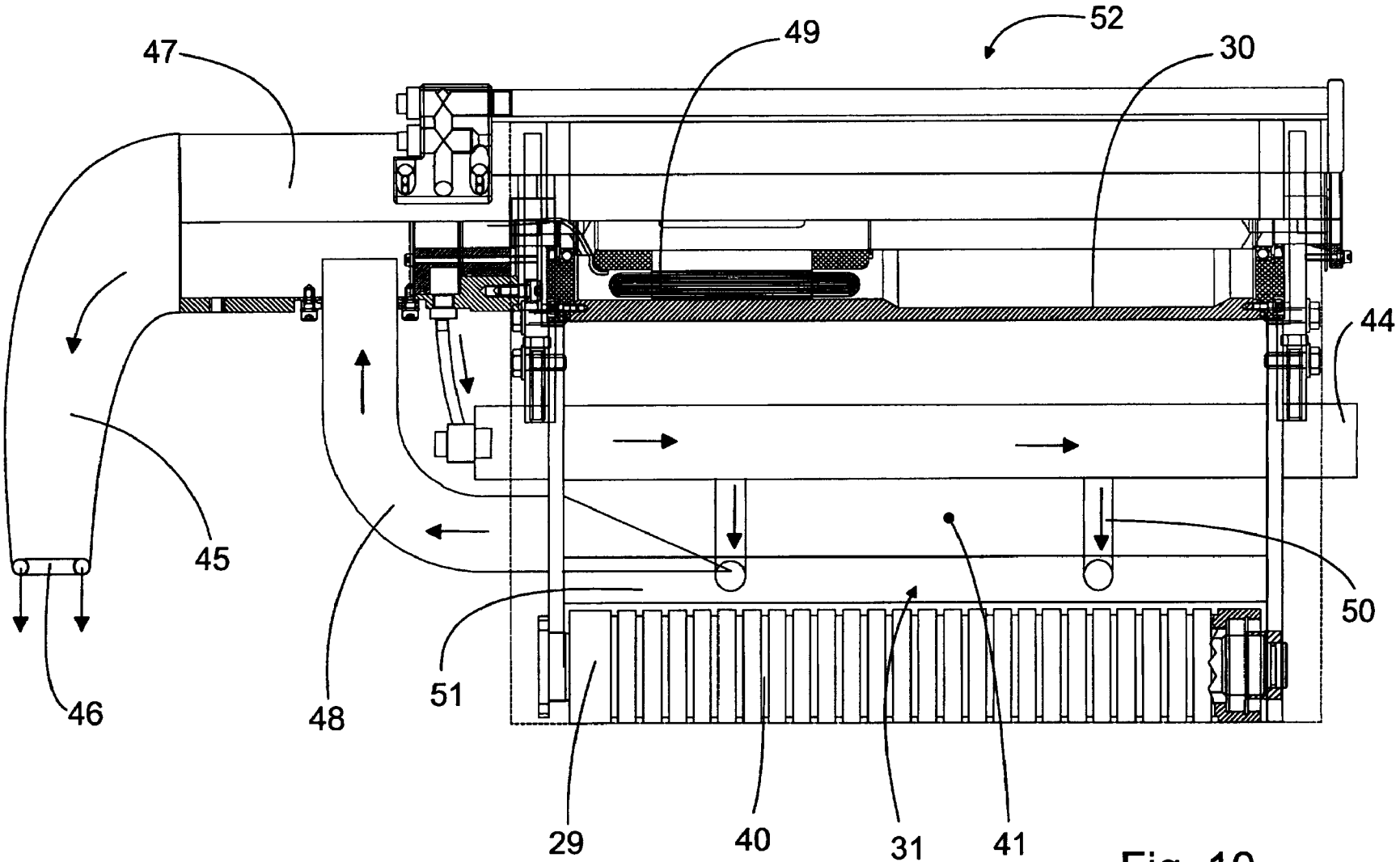
FIG. 10 shows a top view of the application of FIG. 9.

FIGS. 9 and 10 show a third application of the apparatus according to the invention. In this case too, there are two turnover rolls 29 and 30, which support the rotating belt loop 28. According to the above description, a vacuum effect is arranged in connection with the first turnover roll. In place of a perforated jacket, grooves 40 that essentially cover the entire circumference of the drum are used. In addition to this, a chamber 41, in which a vacuum is arranged, is fitted inside the belt loop. The vacuum extends from the chamber through the grooves to the belt loop, thus creating the force necessary to detach the web threading tail. The chamber 41 is bounded by a foil strip 31 with a blowing plate 42 extending from it. The chamber 41 is also bounded a base plate 43 and the feed pipe 44 of the blowing plate 42. This prevents the unnecessary spread of the vacuum and interference with the operation of the foil strip. The air discharging from the blowing plate 42 exits from the side of the apparatus before the second turnover roll 30 and partly through the belt loop 28. The solutions in question achieve an extremely compact construction, which is also effective and reliable in operation.

The construction of the apparatus is new in other ways too. The vacuum is preferably created using compressed air, making separate blowers unnecessary. In the application described, a venturi pipe 45, with a ring nozzle 46 connected to it, is used. The compressed air blown from the orifice of the ring nozzle creates a flow in the venturi pipe and in turn a sufficient vacuum in the apparatus. The venturi pipe 45 is also connected to an intermediate pipe 47, which is correspondingly connected by means of an angle pipe 48 to the chamber 41. In addition, the force required to rotate the belt loop is created by a drum motor. In other words, the motor 49 is inside one of the turnover rolls 30. In addition, the motor is fitted on the attachment point side, thus bringing the center of gravity of the apparatus close to the attachment point. Further, there is a connection from the motor to the intermediate pipe, so that the airflow removes the heated air from the motor.

Compressed air is also used in connection with the blowing plate. For this purpose there is a transverse feed pipe 44 with swan-neck pipes 50 connected to it, which terminate in the actual blowing pipe 51. In the blowing pipe, the compressed air is distributed evenly over the width of the belt loop and then discharged through the holes in the blowing pipe, creating the aforesaid Coanda blowing (not shown). The foil strip and Coanda blowing create a powerful vacuum soon after the first turnover roll. At the approach to the second turnover roll, the vacuum effect diminishes, so that the web threading tail naturally separates from the surface of the belt loop. The separation can be ensured with the aid of air doctors 52, which are arranged in connection with the second turnover roll 30 (FIG. 10). FIG. 9 only shows the direction of blowing of the air doctors. The first blast detaches the web threading tail from the surface of the belt loop while the second blast guides it forwards.

In addition to the above description, the apparatus according to the invention can also be used elsewhere in a paper machine.

Figure 7:
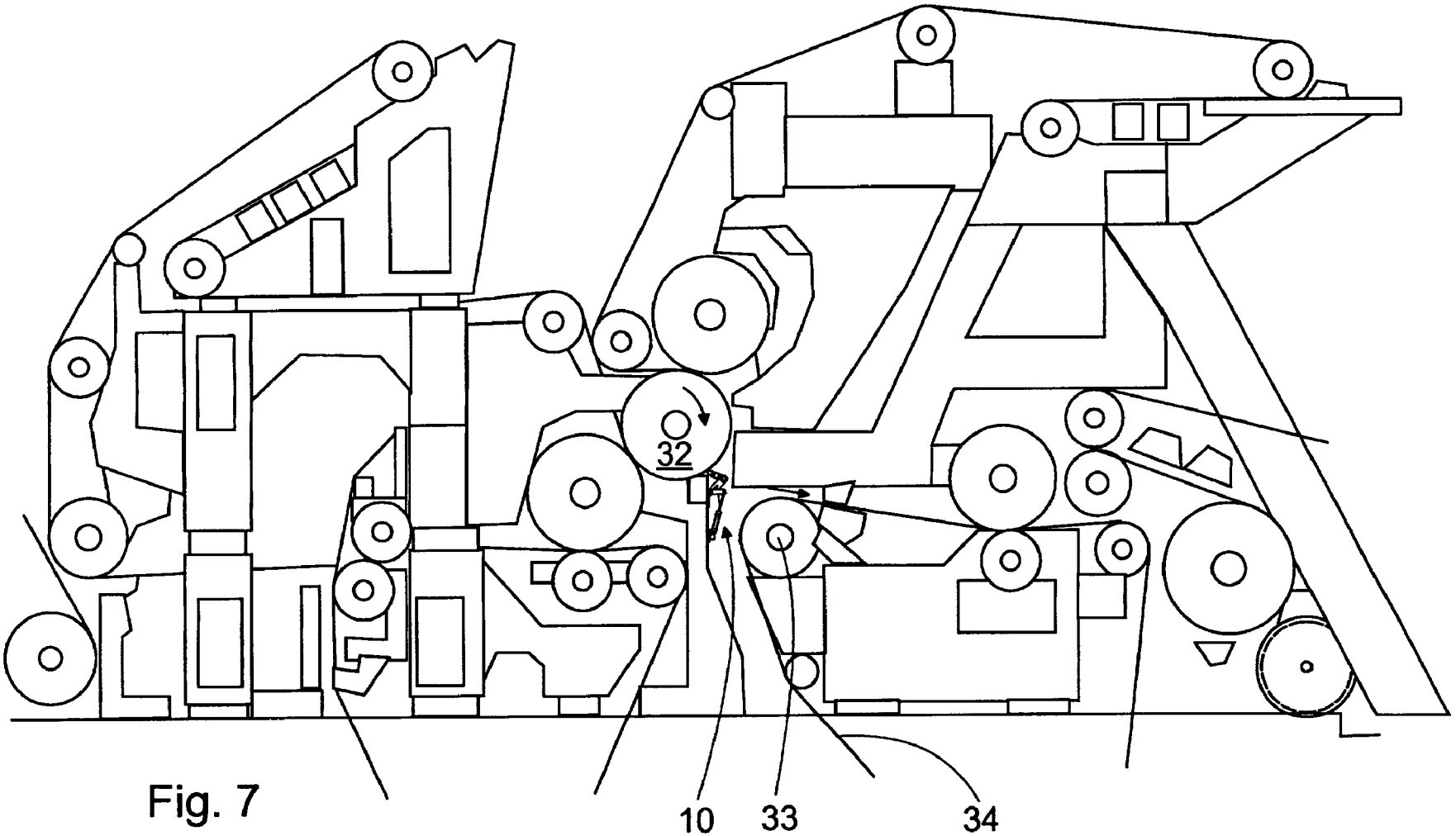
FIG. 7 shows a side view of a press section equipped with an apparatus according to the invention.

One critical empty space is in the press section, which is shown in FIG. 7. At the point in question, the web threading tail is lead from the press roll 32, referred to as the center roll, over the empty space to the support fabric 33, referred to as the transfer belt. The support fabric 33 is guided by turnover rolls 34. By locating an apparatus 10 according to the invention in connection with the center roll, the web threading tail can be easily transferred. Besides a conventional press, the apparatus can also be applied, for example, in a separate press. In paper machines, the web threading tail is detached from the surface of a roll, but in the twin-felt presses of board machines it is detached from the surface of the press felt. There is little difference in terms of the operation of the apparatus, as the vacuum drum acts directly on the web threading tail.

Using the apparatus according to the invention, the web threading tail is first reliably detached from the surface preceding the empty space and then transferred to the surface following the empty space. The use of a vacuum avoids jets and their difficult orientation. In addition, the vacuum required is low, clearly less than 0.1 bar. The apparatus according to the invention is versatile and easily adaptable. In addition, it can be installed in different positions. Retrofitting is also easy. Both members can be rotated appropriately at any time. Usually an electric or pneumatic motor is used, which is preferably fitted in connection with, or even inside a turnover roll. Particularly the exhaust air from a pneumatic motor can be used to create the vacuum inside the drum. Especially in drum applications, the upper limit of the rotation speed is very high, so that a pneumatic motor can be used to rotate the drum at a clearly higher speed in relation to the surface.

The invention claimed is:

1. An apparatus for transferring a threading tail of a web, comprising:

a first drying cylinder having a first surface;

a second drying cylinder having a second surface, the first drying cylinder and the second drying cylinder being spaced apart forming an empty space between the first surface and the second surface, the second surface being downstream of the first surface;

a first turnover roll and a second turnover roll mounted to an arm in spaced apart relation, the first turnover roll and the second turnover roll positioned in the empty space between the first surface and the second surface with the first turnover roll nearer the first surface and the second turnover roll nearer the second surface;

an air permeable belt mounted to form a loop about and supported by the first turnover roll and the second turnover roll and which is arranged to rotate so as to transport the threading tail of the web from the first surface to the second surface;

at least one foil strip arranged within the belt loop to create a vacuum effect on a part of the belt loop between the first turnover roll and the second turnover roll; and a vacuum effect arranged in connection with the first turnover roll.

2. The apparatus of claim 1 wherein the first turnover roll is positioned at a distance of 2-10 mm from the first surface.

3. The apparatus of claim 1 wherein the first turnover roll is positioned at a distance of 3-6 mm from the first surface.

4. The apparatus of claim 1 wherein the vacuum effect arranged in connection with the first turnover roll comprises the first turnover roll having a perforated jacket with an inner circumference, on which the vacuum effect is arranged.

5. The apparatus of claim 4, wherein a vacuum box, which covers 20-70% of the inner circumference is fitted inside the perforated jacket.

6. The apparatus of claim 1 wherein, in order to create the vacuum effect, the first turnover roll has a jacket which has an outer circumference on which are defined longitudinally arranged grooves; and further comprising a chamber fitted inside the belt loop and arranged so that the chamber is delimited by the turnover roll and wherein a vacuum is arranged in the chamber and the vacuum extends from the chamber through the grooves in the jacket outer circumference to the belt loop.

7. The apparatus of claim 6, wherein the longitudinally arranged grooves essentially cover the total outer circumference of the first turnover roll and the grooves increase the surface area of the outer circumference of the turnover roll by 10-30%.

8. The apparatus of claim 6 wherein the longitudinally arranged grooves essentially cover the total outer circumference of the first turnover roll and the grooves increase the surface area of the outer circumference of the turnover roll by 15-25%.

9. The apparatus of claim 1 wherein the arm is articulated and supports the first turnover roll, the second turnover roll and the air permeable belt, so as to permit swiveling between a threading and a rest position.

10. The apparatus of claim 1 wherein the first turnover roll and the second turnover roll are separated by a distance of between 200-600 mm.

11. The apparatus of claim 1 wherein the first turnover roll and the second turnover roll are separated by a distance of between 300-500 mm.

12. The apparatus of claim 1 wherein at least two foil strips are arranged within the belt loop to create a vacuum effect on a part of the belt loop between the first turnover roll and the second turnover roll.

13. The apparatus of claim 1 wherein the belt loop has a longitudinal guide member arranged in the belt loop, and wherein the first turnover roll and the second turnover roll have portions defining a space corresponding to the longitudinal guide member which receives the guide member for retaining the belt loop on the first turnover roll and the second turnover roll.

14. The apparatus of claim 13 wherein the guide member is selected from the group consisting of a protrusion attached to the belt loop and a fold in the belt loop.

15. The apparatus of claim 1 wherein the first drying cylinder and the second drying cylinder are part of a twin-wire dryer section of a paper machine;

wherein a plurality of drying cylinders belonging to the twin-wire dryer section are arranged on a first level and a second level, and on the first level there are third turnover rolls between the drying cylinders for leading a first wire through the consecutive drying cylinders, the first drying cylinder forming one dryer of the first level;

wherein on the second level there are fourth turnover rolls between the drying cylinders for leading a second wire through the consecutive drying cylinders, the second drying cylinder forming one dryer of the second level;

wherein the first turnover roll and the second turnover roll mounted to the arm are arranged between the first level and the second level to lead the threading tail of the web from an opening throat on the first level, the opening throat formed between a first drying cylinder and the first wire on the first level, over the empty space to a closing throat on the second level, the closing throat being formed between the second drying cylinder and the second wire on the second level;

wherein the first turnover roll and the second turnover roll mounted to the arm are arranged to detach the threading tail of the web from the surface of the first drying cylinder and lead the detached threading tail of the web to the closing throat, and the first turnover roll and the second turnover roll mounted to the arm is arranged closely spaced from the first drying cylinder.

16. An apparatus for transferring a threading tail of a web in a paper machine, comprising:

a first surface;

a second surface, the first surface and the second surface being spaced apart forming an empty space, the second surface being downstream of the first surface;

a first turnover roll and a second turnover roll mounted to an arm in spaced apart relation, the first turnover roll and the second turnover roll being positioned in the empty space between the first surface and the second surface with the first turnover roll nearer the first surface and the second turnover roll nearer the second surface;

an air permeable belt mounted to form a loop about and supported by the first turnover roll and the second turnover roll, the belt being arranged to rotate so as to transport a threading tail of the web from the first surface to the second surface;

at least one foil strip arranged within the belt loop to create a vacuum effect on a part of the belt loop between the first turnover roll and the second turnover roll; and a vacuum effect arranged in connection with the first turnover roll, wherein the belt loop has portions defining a longitudinal guide member which extends circumferentially about the belt loop, and extends inwardly from an inner surface defined by the belt loop, and wherein the guide member is arranged to guide the belt loop with respect to the first turnover roll, and the second turnover roll.

17. The apparatus of claim 16 wherein the first turnover roll and the second turnover roll have portions defining circumferential grooves which provide a space corresponding to the longitudinal guide member and which receive the guide member for retaining the belt loop on the first turnover roll and the second turnover roll.

* * * * *